United States Patent [19]

Emslander

[11] Patent Number: 4,930,646

[45] Date of Patent: Jun. 5, 1990

[54] CAPLINER/INNERSEAL COMPOSITE UTILIZING COLD SEAL ADHESIVE

[75] Inventor: Jeffrey O. Emslander, Oakdale, Minn.

[73] Assignee: Minnesota Mining and Manufacturing Company, St. Paul, Minn.

[21] Appl. No.: 305,412

[22] Filed: Feb. 1, 1989

[51] Int. Cl.[5] ..... B65D 55/02

[52] U.S. Cl. ..... 215/232; 215/347; 428/352

[58] Field of Search ..... 215/232, 234, 258, 341, 215/347, 349, DIG. 2, DIG. 4; 428/352

[56] References Cited

U.S. PATENT DOCUMENTS

| | | | |
|---|---|---|---|
| 3,330,720 | 7/1967 | Stevens et al. | 215/347 X |
| 4,327,147 | 4/1982 | Ou-Yang | 156/212 X |
| 4,398,985 | 8/1983 | Eagon | 428/352 X |
| 4,418,834 | 12/1983 | Helms et al. | 215/232 X |
| 4,448,345 | 5/1984 | Helms | 215/232 X |
| 4,588,099 | 5/1986 | Diez | 215/232 |
| 4,588,465 | 5/1986 | Paciorek | 215/347 X |
| 4,684,554 | 8/1987 | Ou-Yang | 215/232 X |

FOREIGN PATENT DOCUMENTS

| | | | |
|---|---|---|---|
| 6151664 | 11/1981 | Japan | 215/347 |
| 0048466 | 10/1982 | Japan | 215/347 |

*Primary Examiner*—Stephen P. Garbe
*Assistant Examiner*—Christine A. Peterson
*Attorney, Agent, or Firm*—Donald M. Sell; Walter N. Kirn; David L. Weinstein

[57] ABSTRACT

Composite capliner/innerseal for containers. The composite capliner/innerseal comprises, from top to bottom:

(a) a capliner,
(b) a layer of release film,
(c) a first layer of adhesive,
(d) an innerseal, and
(e) a second layer of adhesive.

The release film acts to separate the capliner from the innerseal upon application of a sufficient amount of force. The first layer of adhesive bonds the capliner/-release film assembly to the innerseal; the second layer of adhesive bonds the capliner/innerseal composite to the mouth of the container.

18 Claims, 2 Drawing Sheets

CAPLINER/INNERSEAL COMPOSITE UTILIZING COLD SEAL ADHESIVE

BACKGROUND OF THE INVENTION

1. Field of the Invention

This invention relates to innerseals and capliners for containers.

2. Discussion of the Prior Art

Innerseals for containers are typically made of a disk-shaped sheet of a metallic foil/polymeric layer laminate which is sealed to the mouth of the container by means of induction heating.

Typical sheet stock for preparing such innerseals is made by bonding a sheet of the foil/polymeric layer laminate to a sheet of pulpboard by means of a layer of wax. The wax layer holds the laminate and pulpboard sheet together, so that the innerseal can be formed from the innerseal sheet stock in a single pass on conventional caplining equipment. After the sheet stock for preparing the innerseal is punched into disks, the resulting disks are glued into container caps on the caplining equipment. The cap is then applied to the container, and the capped container is then passed through an induction field to seal the innerseal to the container. In the induction heat sealing process, as the container is passed through an electromagnetic field, the field induces currents in the metallic foil, generating heat very rapidly by means of resistance heating of the foil. The heated foil causes the polymeric layer of the innerseal, which is in contact with the container mouth, to melt and form a bond upon cooling, thereby sealing the innerseal to the container mouth. In the induction field, the heated foil serves two purposes: the first is to seal the innerseal disk to the container as described above; the second is to melt the wax layer, whereby the wax is absorbed into the pulpboard layer, breaking the bond between the capliner and innerseal, thus allowing the cap to be easily removed from the container after sealing.

An innerseal that would not require induction heat sealing would be advantageous to a food packager, because it would eliminate the induction heat sealing step in the production process, thus leading to lower costs. However, because the induction sealing process also insures separation of the capliner from the innerseal, elimination of the induction sealing step would make separation of the capliner from the innerseal extremely difficult, further making it difficult to remove the cap from the container. One method of supplying a capliner and a non-induction sealable innerseal into a cap for use is by double punching, in which the capliner is first cut and glued into a cap and the innerseal is punched into the lined cap in a separate operation. This method, however, requires two steps. A material which would require neither induction heat sealing nor double punching would require the capliner and innerseal to be bonded in such a way that the capliner/innerseal composite is strong enough to be handled on conventional caplining equipment, yet will separate easily enough so that the user of the container will encounter low cap removal torques when the container is opened. Unfortunately, however, with most adhesives, the bond between the capliner and innerseal would be so strong that the cap cannot be twisted off a sealed container.

SUMMARY OF THE INVENTION

This invention provides a composite capliner/innerseal for containers. The composite capliner/innerseal comprises, from top to bottom:

- a capliner, which typically is a layer of polymeric foam;
- a layer of release film, which acts to separate the capliner portion of the composite from the innerseal portion of the composite upon application of a sufficient amount of torque in the case of a twist-off cap or of lift force in the case of a snap-top cap;
- a first layer of adhesive, which acts to bond the capliner/release film portion of the composite to the innerseal portion of the composite;
- an innerseal, which is typically a layer of polymeric film;
- a second layer of adhesive, which acts to bond the innerseal portion of the composite to the mouth of the container.

Preferably, the layer of release film is applied to the capliner by means of solvent coating, and the resulting coated capliner is bonded to the innerseal by means of a pressure-sensitive adhesive.

The release film must adhere sufficiently well to the capliner so that the capliner/innerseal composite can be handled on conventional caplining equipment, yet the capliner must be separable from the innerseal upon application of low level of removal torque, e.g., twisting of the cap of the container, or lift, e.g., pulling of the cap of the container. The material of the release film must be selected so that adhesion between the release film and capliner is less than adhesion between the release film and adhesive layer of innerseal. The capliner prevents leakage of contents after the container is opened.

DETAILED DESCRIPTION

Figure 2:
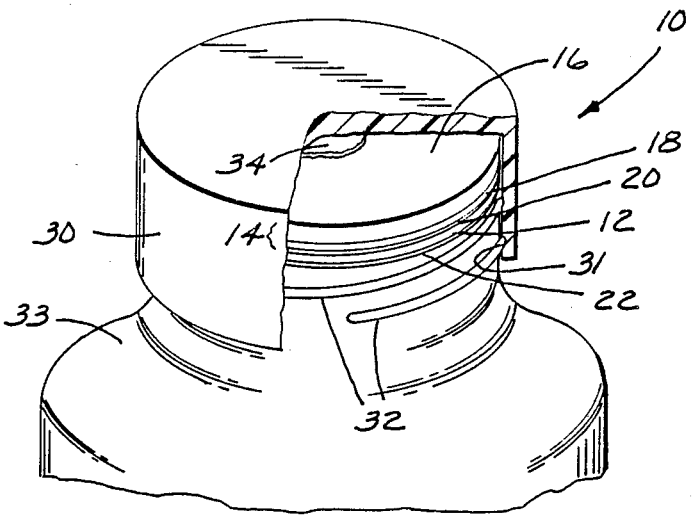
FIG. 2 is a sectional view, in perspective, of a cap and capliner/innerseal composite constructed in accordance with the present invention and sealed to a container.
Figure 1:
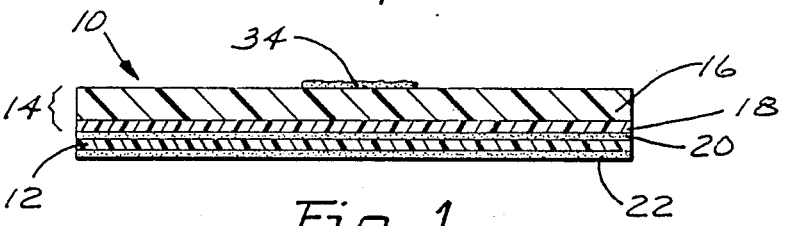
FIG. 1 is a sectional view, in elevation, of the capliner/innerseal composite of this invention.

Referring now to FIG. 1, capliner/innerseal composite 10 comprises an innerseal 12, a composite layer 14 comprising a capliner 16 and a layer of release film 18. The composite layer 14 is bonded to one major surface of innerseal 12 by means of a first layer of adhesive 20 with the layer of release film 18 facing the innerseal 12. A second layer of adhesive 22 is coated on the major surface of the innerseal 12 opposite the surface of the innerseal 12 bearing the composite layer 14.

Innerseal 12 is preferably made of a polymeric material. Innerseal 12 should preferably be capable of elastic deformation; it should preferably have a modulus of elasticity value of from about $0.05\times10^5$ to about $5.0\times10^5$ lb /in$^2$, more preferably about $0.1\times10^5$ lb /in$^2$.

Representative examples of polymeric materials suitable for innerseal 12 include polyolefins, e.g., polyethylene, polypropylene, polyesters, e.g., polyethylene terephthalate, metallized polymeric films, saran coated polymeric films, e.g., saran coated polypropylene, barrier coated polymeric films. A preferred material is saran coated polypropylene. As used herein, "saran" means vinyl chloride-vinylidene chloride copolymer. Metallic foils can also be used as the material for innerseal 12, so long as they are treated in such a way, as, for example, by embossment, so that a vertical peel component is introduced into the capliner/release film composite.

Capliner 16 can be made of any polymeric material conventionally used to make capliners. Representative examples of polymeric materials suitable for capliner 16 include resilient polymeric foam, preferably closed cell foam. A preferred material is polyolefin foam, e.g., polyethylene foam, polypropylene foam. The material for capliner 16 should be sufficiently resilient so as to allow slight out-of-plane deformation to convert some of the shear forces to peel forces.

Release layer 18 is preferably applied to the capliner 16 from a coating solution. A material suitable for preparing the layer 18 of release film is ethylcellulose.

The composite 14 and innerseal layer 12 can be bonded with a laminating adhesive. Laminating adhesives that are suitable for the present invention include pressure-sensitive adhesives, e.g., rubber-based adhesives, acrylic-based adhesives, silicone-based adhesives, a preferred laminating adhesive being rubber-based adhesives sold under the trademark Kraton ®, available from Shell Chemical Co.

Innerseal 12 can be bonded to the mouth of the container by means of a sealing adhesive. Sealing adhesives that are suitable for bonding the innerseal of this invention to a container include shear-activated adhesives, e.g., such as that described in U.S. Pat. No. 4,327,147, incorporated herein by reference, or pressure-sensitive adhesives, so long as the product is neither a food nor a drug. Representative examples of sealing adhesives suitable for this invention include nitrile rubber-based adhesives. A preferred nitrile rubber-based adhesive is acrylonitrile-butadiene rubber adhesive.

The dimensions of each layer can vary, but preferably fall within the following averages:

| Layer | Preferred thickness range (mils) | Optimum thickness (mils) |
|---|---|---|
| Capliner | 15–55 | 40 |
| Innerseal | 1–3 | 2 |
| Laminating adhesive | ¼–less than 1 | ½ |
| Sealing adhesive | 1 ½–5 | 2 |
| Release layer | ¼–less than 1 | ½ |

A cap 30 is formed of a polymer, having a top and connecting side walls with internal threads 31 to mate with threads 32 provided on the outer surface about the neck and opening of container 33. Cap 30 is formed of polyolefin or other suitable polymeric material, and could be a snap fitted cap to mate with a rib formed about the opening of the container, such as conventional child-proof caps having an arrow thereon which is rotated to match an arrow or location on the container, at which location the cap may be snapped off. The threaded cap is chosen for purposes of illustration.

The capliner/innerseal composite is typically placed inside the cap by the cap manufacturer. Caps are supplied to the packager with the innerseal already placed in the cap. The capliner/innerseal composite 10 is typically bonded to cap 30 by means of a small patch of adhesive 34.

Figure 3:
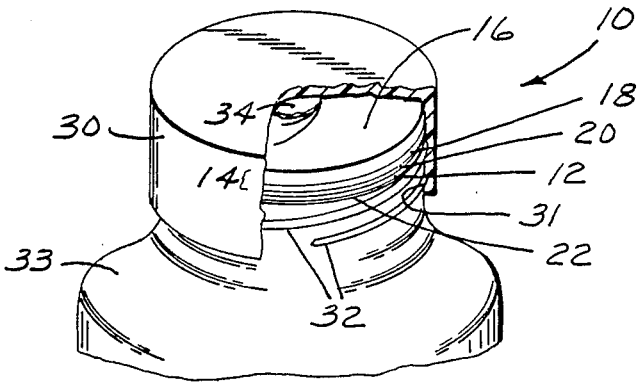
FIG. 3 is a sectional view, in perspective, of a cap and capliner/innerseal composite constructed in accordance with the present invention and sealed to a container, after the cap has been twisted in a direction so as to remove it from the container.
Figure 4:
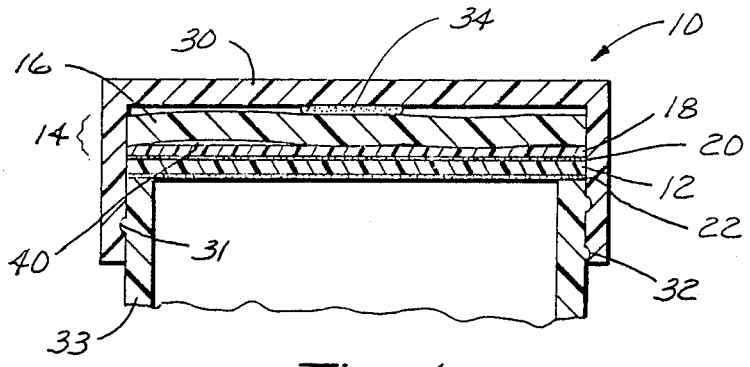
FIG. 4 is a sectional view, in elevation, of the cap and capliner/innerseal composite of this invention and sealed to a container, after the cap has been twisted in a direction so as to remove it from the container.

As illustrated in FIGS. 3 and 4, rotation of cap 30 in an unwinding direction, with capliner/innerseal composite 10 in place, causes the capliner to peel away from the release layer on opening as illustrated at 40. Continued relative rotation of the cap and container will result in the capliner being separated from the innerseal.

The value of release torque is dependent upon the size of the cap. As cap size, i.e., diameter, increases, the value of release torque also increases. As a general rule ½ in.-lb. of release torque is required for each millimeter of cap diameter. For example, a 38 mm cap requires 19 in.-lb. of release torque. The value of peel preferably ranges from about ½ oz/in. to about 10 oz/in. A preferred value of peel is 1 oz/in. The release layer is chosen so that it will have high shear and very low peel from the foam capliner.

As the cap is rotated, slight wrinkles form in the resilient foam capliner, thus converting some of the shear force into peel, thereby allowing the release layer to easily release from the foam capliner.

The capliner/innerseal composite described herein is useful with containers made of polymeric material, such as, for example, polyvinyl chloride, polyethylene terephthalate, and polystyrene.

The capliner/innerseal composite of this invention allows the capliner and the innerseal to be laminated together, and yet be easily releasable upon application of low removal torque. A capliner/innerseal composite that does not have the release layer described herein would require extremely high removal torques to remove the cap from the container. This high torque would ordinarily result in distortion or tearing of the innerseal. Because this capliner/innerseal composite can be applied to the container by means other than induction heating, the requirement of metallic foil is eliminated, which results in significantly lower materials cost.

The following, non-limiting example, further illustrates the capliner/innerseal composite of this invention. All percentages are percentages by weight, unless otherwise indicated.

EXAMPLE 1

A capliner made of polyethylene foam having a thickness of about 40 mil was coated with a solution of ethylcellulose dissolved in a solvent mixture containing 75% toluene and 25% methyl ethyl ketone. The solution contained 10% dry solids. Coating was conducted by means of a knife coater having a 6 mil orifice.

The innerseal was made of a composite of polypropylene/saran film ("Hercules" CWT501/1S, Hercules, Inc.). A laminating adhesive (20% solids solution of 50% styrene-isobutadiene-styrene ("Kraton" 1107, Shell Chemical Co.) and 50% α-pinene ("Piccolyte" A135, Hercules, Inc.) in toluene) was coated onto the polypropylene surface of the polypropylene/saran film and the adhesive-coated surface of the film was laminated to the cellulose-coated surface of the capliner.

The saran surface of the innerseal was coated with a 20% solids solution of nitrile rubber ("Chemigum" N644B, The Goodyear Tire and Rubber Co.) in methyl ethyl ketone.

EXAMPLE 2

A capliner made of polyethylene foam having a thickness of about 40 mil was coated with a solution of ethylcellulose dissolved in a solvent mixture containing 75% toluene and 25% methyl ethyl ketone. The solution contained 10% dry solids. Coating was conducted by means of a knife coater having a 6 mil orifice.

The innerseal was made of a composite of polypropylene/saran film ("Hercules" CWT501/1S, Hercules, Inc.). A laminating adhesive (20% solids solution of 50% styrene-isobutadiene-styrene ("Kraton" 1107, Shell Chemical Co.) and 50% α-pinene ("Piccolyte" A135, Hercules, Inc.) in toluene) was coated onto the polypropylene surface of the polypropylene/saran film and the adhesive-coated surface of the film was laminated to the cellulose-coated surface of the capliner.

The saran surface of the innerseal was coated with a 20% solids solution of nitrile rubber in toluene. The nitrile rubber was a random copolymer of butadiene and acrylonitrile. The copolymer comprised 25% by weight acrylonitrile. The copolymer had a Mooney viscosity of 130. The nitrile rubber was prepared according to the procedure described in assignee's copending application, filed on even date herewith. This procedure is as follows:

The following materials in the amounts indicated were used to prepare the adhesive of Example 2.

| Ingredients | Amount (parts by weight) |
|---|---|
| Acrylonitrile | 22 |
| Butadiene | 78 |
| Distilled water | 180 |
| Alkali salt of dehydroabietic acid | 3.6 |
| Tert-dodecyl mercaptan | 0.4 |
| Hydrogen peroxide (20%) | 0.4 |
| Iron sulfate heptahydrate | 0.02 |
| Sodium hyposulfite | 1.0 |
| Trinonyl phenyl phosphite | 3.0 |

The distilled water, the alkali salt of dehydroabietic acid, the tert-dodecyl mercaptan, the butadiene, and 12 parts acrylonitrile, were introduced into a clean container.

The resulting solution (emulsion) was agitated for about five minutes; then the hydrogen peroxide and iron sulfate heptahydrate were added; the emulsion continued to be agitated while the temperature was held at 7° C. When the level of conversion reached about 35%, the remainder of the acrylonitrile was added to the container.

Polymerization was continued at 7° C. for about 16 hours. At that point, the sodium hyposulfate and trinonyl phenyl phosphite was added to terminate the polymerization.

Alum was added to coagulate the polymerized latex into a crumb form, and the crumb-like material was thoroughly washed with water to eliminate excess precipitated agents, such as emulsifier, modifier, etc. The crumb-like material was then dried.

Various modifications and alterations of this invention will become apparent to those skilled in the art without departing from the scope and spirit of this invention, and it should be understood that this invention is not to be unduly limited to the illustrative embodiment set forth herein.

What is claimed is:

1. Capliner/innerseal composite comprising a planar capliner having sufficient resilience such that when subjected to shear force, out-of-plane deformation will occur to convert some of said shear force to peel force, a layer of release film applied to one major surface of said capliner, a first layer of adhesive which bonds the release film to an innerseal, and a second layer of adhesive which is capable of bonding the innerseal to the mouth of a container, the adhesion between said layer of release film and said capliner being less than the adhesion between said layer of release film and said first layer of adhesive.

2. The capliner/innerseal composite of claim 1, wherein said capliner comprises a layer of polymeric foam.

3. The capliner/innerseal composite of claim 1, wherein said capliner comprises a layer of polyethylene film.

4. The capliner/innerseal composite of claim 1, wherein the value of peel of said release film ranges from about ½ oz/in. to about 10 oz/in.

5. The capliner/innerseal composite of claim 1, wherein said first layer of adhesive is a pressure-sensitive adhesive.

6. The capliner/innerseal composite of claim 1, wherein said second layer of adhesive is a torque-activatable adhesive.

7. The capliner/innerseal composite of claim 1, wherein said second layer of adhesive is a pressure-sensitive adhesive.

8. Container comprising the capliner/innerseal composite of claim 1.

9. Container cap comprising the capliner/innerseal composite of claim 1.

10. Capliner/innerseal composite comprising a planar capliner having sufficient resilience such that when subjected to lift force, out-of-plan deformation will occur to convert some of said lift force to peel force, a layer of release film applied to one major surface of said capliner, a first layer of adhesive which bonds the release film to an innerseal, and a second layer of adhesive which is capable of bonding the innerseal to the mouth of a container, the adhesion between said layer of release film and said capliner being less than the adhesion between said layer of release film and said first layer of adhesive.

11. The capliner/innerseal composite of claim 10 wherein said capliner comprises a layer of polymeric foam.

12. The capliner/innerseal composite of claim 10, wherein said capliner comprises a layer of polyethylene film.

13. The capliner/innerseal composite of claim 10, wherein the value of peel of said release film ranges from about ½ oz/in. to about 10 oz/in.

14. The capliner/innerseal composite of claim 10, wherein said first layer of adhesive is a pressure-sensitive adhesive.

15. The capliner/innerseal composite of claim 10, wherein said second layer of adhesive is a torque-activatable adhesive.

16. The capliner/innerseal composite of claim 10, wherein said second layer of adhesive is a pressure-sensitive adhesive.

17. Container comprising the capliner/innerseal composite of claim 11.

18. Container cap comprising the capliner/innerseal composite of claim 10.

* * * * *